US009788599B2

(12) United States Patent
Hesterberg et al.

(10) Patent No.: US 9,788,599 B2
(45) **Date of Patent: *Oct. 17, 2017**

(54) TORSION CONTROL BRIDGE FOR SHOE

(71) Applicant: TAYLOR MADE GOLF COMPANY, INC., Carlsbad, CA (US)

(72) Inventors: Michael Hesterberg, Carlsbad, CA (US); Sven Tulowitzki, Carlsbad, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/838,190

(22) Filed: Aug. 27, 2015

(65) Prior Publication Data

US 2016/0353835 A1 Dec. 8, 2016

Related U.S. Application Data

(60) Provisional application No. 62/170,353, filed on Jun. 3, 2015.

(51) Int. Cl.
*A43B 13/12* (2006.01)
*A43B 13/14* (2006.01)
(Continued)

(52) U.S. Cl.
CPC ..... *A43B 13/141* (2013.01); *A43B 5/001* (2013.01); *A43B 7/14* (2013.01); *A43B 7/1495* (2013.01);
(Continued)

(58) Field of Classification Search
CPC ..... A43C 11/165; A43B 5/001; A43B 7/1495; A43B 13/12; A43B 13/122; A43B 13/125; A43B 23/22; A43B 23/222; A43B 23/227
(Continued)

(56) References Cited

U.S. PATENT DOCUMENTS 1,572,213 A * 2/1926 Lucas ..... A43B 3/0052 36/11.5
5,371,957 A 12/1994 Gaudio
(Continued)

FOREIGN PATENT DOCUMENTS

TW M412636 U1 10/2011
WO WO 01/15559 A1 3/2001

OTHER PUBLICATIONS

European Search Report in European Patent Application No. 16169112, dated Oct. 27, 2016, in 8 pages.
(Continued)

*Primary Examiner* — Ted Kavanaugh
(74) *Attorney, Agent, or Firm* — Duane Morris LLP

(57) ABSTRACT

A shoe and method of manufacturing same, the shoe including: an upper configured to receive therein a foot of a wearer of the shoe, the upper comprising a closure and a tongue configured to cover a top portion of the foot; a front sole portion attached to a front portion of a bottom surface of the upper; a heel sole portion attached to a heel portion of the bottom surface of the upper; and a torsion control bridge connecting the front and heel sole portions, wherein a window is formed between the torsion control bridge and a portion of the bottom surface of the upper located between the front and heel sole portions.

28 Claims, 5 Drawing Sheets

(51) Int. Cl.

| | |
|---|---|
| ***A43B 7/14*** | (2006.01) |
| ***A43B 5/00*** | (2006.01) |
| ***A43C 11/16*** | (2006.01) |
| ***A43B 13/22*** | (2006.01) |
| ***A43B 23/22*** | (2006.01) |

(52) U.S. Cl.
CPC ..... *A43B 13/12* (2013.01); *A43B 13/223* (2013.01); *A43B 23/22* (2013.01); *A43B 23/227* (2013.01); *A43C 11/165* (2013.01)

(58) Field of Classification Search
USPC ..... 36/91, 50.1
See application file for complete search history.

(56) References Cited

U.S. PATENT DOCUMENTS

| | | | | |
|---|---|---|---|---|
| 5,819,439 | A * | 10/1998 | Sanchez | A43B 5/00 36/50.1 |
| 6,772,541 | B1 * | 8/2004 | Ritter | A43B 7/14 36/50.1 |
| 8,006,410 | B2 * | 8/2011 | Romboli | A43C 11/1493 36/50.1 |
| 8,468,657 | B2 | 6/2013 | Soerberg et al. | |
| 8,516,662 | B2 | 8/2013 | Goodman et al. | |
| 2003/0000109 | A1 | 1/2003 | Kita | |
| 2003/0005600 | A1 | 1/2003 | Kita | |
| 2003/0029060 | A1 * | 2/2003 | Hockerson | A43B 5/02 36/67 R |
| 2003/0204938 | A1 | 11/2003 | Hammerslag | |
| 2004/0025375 | A1 | 2/2004 | Turner et al. | |
| 2004/0118016 | A1 * | 6/2004 | Tonkel | A43B 3/102 36/11.5 |
| 2004/0181972 | A1 | 9/2004 | Csorba | |
| 2007/0101617 | A1 | 5/2007 | Brewer et al. | |
| 2009/0199435 | A1 | 8/2009 | Robinson et al. | |
| 2010/0047550 | A1 | 2/2010 | Prissok et al. | |
| 2010/0154257 | A1 | 6/2010 | Bosomworth et al. | |
| 2010/0218397 | A1 | 9/2010 | Nishiwaki | |
| 2010/0222442 | A1 | 9/2010 | Prissok et al. | |
| 2011/0154689 | A1 | 6/2011 | Chung | |
| 2011/0239486 | A1 | 10/2011 | Berger et al. | |
| 2012/0065285 | A1 | 3/2012 | Braun et al. | |
| 2013/0092780 | A1 | 4/2013 | Soderberg et al. | |
| 2013/0291409 | A1 | 11/2013 | Reinhardt et al. | |
| 2013/0298425 | A1 | 11/2013 | McDonald | |
| 2014/0117140 | A1 | 5/2014 | Goodman et al. | |
| 2014/0123449 | A1 | 5/2014 | Sodergerg et al. | |
| 2014/0223779 | A1 | 8/2014 | Elder et al. | |
| 2014/0223783 | A1 | 8/2014 | Wardlaw et al. | |
| 2015/0257489 | A1 * | 9/2015 | Trudel | A43C 11/20 24/68 SK |
| 2015/0366289 | A1 | 12/2015 | Rustam et al. | |

OTHER PUBLICATIONS

Adidas Tour360 Boost (ADIDAS) Dec. 11, 2015. Retrieved from the Internet on Aug. 4, 2016. URL: http://www.thehackersparadise.com/forum/showthread.php?77019-Adidas-Tour360-Boost.

International Search Report and Written Opinion in International Application No. PCT/US2016/035676, dated Sep. 6, 2016, in 20 pages.

International Search Report and Written Opinion in International Patent Application No. PCT/US2016/035704, dated Oct. 5, 2016, in 12 pages.

* cited by examiner

TORSION CONTROL BRIDGE FOR SHOE

RELATED PATENT APPLICATIONS

This application claims benefit of priority under 35 U.S.C. §119(e) to Provisional Application No. 62/170,353, entitled "SHOES HAVING WRAP-AROUND WIRE SUPPORT AND TORSIONAL CONTROL," filed Jun. 3, 2015, which is incorporated by reference herein in its entirety.

FIELD OF THE INVENTION

The invention is generally related to shoes used during sporting activities and, more particularly, to a pair of shoes having increased support and/or torsion control properties and features to optimize performance and other characteristics of the shoes during a particular sporting activity (e.g., golf).

BACKGROUND OF THE INVENTION

Many sporting activities today require shoes that provide enhanced stability, traction and performance to the athletes that wear them. For example, in golf, the golfer's footwork during the swing is complex and generates many different forces on the golfer's feet that must be absorbed, withstood and/or compensated for by the golfer's shoes. In general, for most golf shots the golfer's weight is initially loaded 50/50 on each foot and the golfer's weight is typically distributed evenly across the bottom surface area of each foot. During the backswing, a majority of the golfer's weight typically shifts to the outside (lateral side) of the golfer's back foot while the front foot maintains some weight for balance. The backswing applies forces tending to spin or pivot the back forefoot outwardly and the back heel inwardly, which must be resisted by the back foot's contact with the ground to keep the golfer's back foot stable.

During the downswing of the club, the golfer's weight begins to shift and by the time the golf ball is struck, the golfer's weight is again evenly distributed between the rear and front feet, or has started to shift more to the front foot. At the finish position of the swing, most of the golfer's weight is on the front foot with more weight on the outside (lateral side) of the front foot than the inside (medial side), and the heel of the golfer's back foot is elevated above the ground and faces rearwardly. In a proper swing, only the toe portion of the golfer's rear foot remains in contact with the ground at the finish. Thus, in the finish position, the heel and most of the outsole of the golfer's rear shoe are off of the ground, with only the toe portion contacting the ground for balance.

As discussed above, the golfer's feet make complex movements during a golf swing to keep the golfer balanced while generating torque and club head speed to strike the golf ball. During various stages of the golf swing, significant forces in various directions are exerted on the left and right shoes. Thus, it is desirable that the shoes provide enhanced stability, traction and torsion control in order to withstand and react appropriately to these forces and maximize the performance of the golfer's footwork during the golf swing. Similar circumstances exist during other sports such as baseball (e.g., during a batter's swing) and track & field (e.g., during start and running on a track), for example.

In order to address the above exemplary needs, it is desirable to optimize various characteristics of shoes (e.g., arch support, torsion, flexibility, stiffness, weight, etc.) to provide the best comfort, fit, stability and performance to a wearer of the shoes, generally, and more particularly, to an athlete wearing the shoes during a sporting activity.

SUMMARY OF THE INVENTION

The invention addresses the above and other needs by providing shoes with improved comfort, fit, stability and performance to a wearer of the shoes.

In one embodiment of the invention, a shoe is provided that includes: an upper configured to receive therein a foot of a wearer of the shoe, the upper comprising a closure and a tongue configured to cover a top portion of the foot; a front sole portion attached to a front portion of a bottom surface of the upper; a heel sole portion attached to a heel portion of the bottom surface of the upper; and a torsion control bridge connecting the front and heel sole portions, wherein a window is formed between the torsion control bridge and a portion of the bottom surface of the upper located between the front and heel sole portions.

In a further embodiment, the invention provides a golf shoe that includes: an upper configured to receive therein a foot of a wearer of the shoe, the upper comprising a closure and a tongue configured to cover a top portion of the foot; a front sole portion attached to a front portion of a bottom surface of the upper, the front sole portion comprising a front midsole comprising a first material and a front outsole comprising a second material that is more rigid than the first material; a heel sole portion attached to a heel portion of the bottom surface of the upper, the heel sole portion comprising a heel midsole comprising the first material and a heel outsole comprising the second material; an arch outsole comprising the second material and connecting the front and heel outsoles, wherein a window is formed between the arch outsole and a portion of the bottom surface of the upper located between the front and heel sole portions; and a plurality of traction elements disposed on bottom surfaces of the front, mid and heel outsoles.

In yet another embodiment, a method of manufacturing a shoe includes: providing an upper configured to receive therein a foot of a wearer of the shoe, the upper comprising a closure and a tongue configured to cover a top portion of the foot; attaching a front sole portion to a front portion of a bottom surface of the upper; attaching a heel sole portion to a heel portion of the bottom surface of the upper; and providing a torsion control bridge between the front and heel sole portions, wherein a window is formed between the torsion control bridge and a portion of the bottom surface of the upper located between the front and heel sole portions.

BRIEF DESCRIPTION OF THE DRAWINGS

In the following description of exemplary embodiments, reference is made to the following Figures which form a part hereof, and in which it is shown by way of illustration specific embodiments in which the invention may be made and practiced. It is to be understood that other embodiments may be utilized, and design and/or structural changes may be made, without departing from the scope of the invention. The Figures are provided for purposes of illustration only and merely depict exemplary embodiments of the invention to facilitate the reader's understanding of the invention and should not be considered limiting of the breadth, scope, or applicability of the invention. It should be noted that for clarity and ease of illustration these drawings are not necessarily drawn to scale.

DETAILED DESCRIPTION OF EXEMPLARY EMBODIMENTS OF THE INVENTION

In the following description of exemplary embodiments, reference is made to the accompanying drawings which form a part hereof, and in which it is shown by way of illustration of specific embodiments in which the invention may be practiced. It is to be understood that other embodiments may be utilized and structural changes may be made without departing from the scope of the invention. Although various embodiments and features of the invention are described below in the context of golf shoes, it will be apparent to those of ordinary skill in the art that various features and advantages of the invention can be applied to shoes used during other types of sporting activities.

Figure 1:
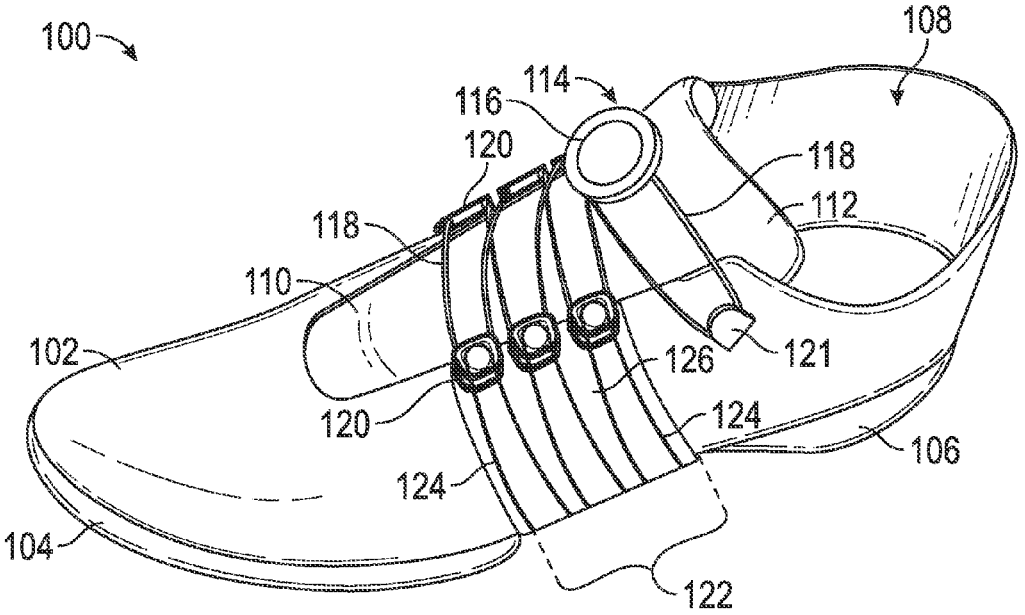
FIG. 1 is a perspective view of a left shoe, in accordance with one embodiment of the invention.
Figure 8:
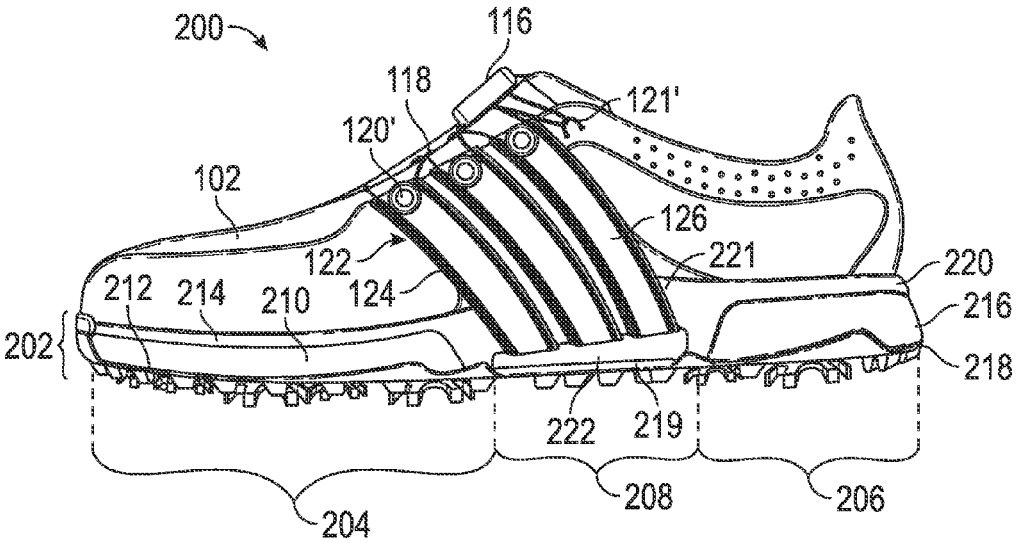
FIG. 8 is a side view of a golf shoe, in accordance with one embodiment of the invention.

FIG. 1 illustrates a perspective view of a left shoe 100, in accordance with one embodiment of the invention. The shoe 100 includes an upper 102 for covering a top surface of a wearer's foot and front sole portion 104 and a heel sole portion 106 each attached to respective bottom surfaces of the upper 102. As described in further detail below with reference to FIG. 4, in one embodiment, the front sole portion 104 and the heel sole portion 106 are two separate sole portions that leave exposed a mid-portion of the upper 102. In an alternative embodiment, an arch midsole reinforcement structure 221 (FIG. 8) is affixed to an arch portion of the bottom surface of the upper 102 to provide further support and stability to this region of the shoe, as shown in FIG. 8 and described in further detail below.

The upper 102 includes an opening 108 through which a wearer's foot (not shown) may be inserted, and a closure 110 that allows a top portion of the upper 102 to be expanded or widened for easier insertion of the wearer's foot and thereafter closed or tightened around the wearer's foot. A flexible tongue 112 forms part of the closure 110 and is fixed to an underside of the upper 102 near the bottom of the closure 110 and extends upwardly past a top portion of the closure 110 so as to cover a top surface of the wearer's foot that would otherwise be exposed. As is known in the art, the tongue 112 provides a cushioning cover above a top surface of the wearer's foot around which the closure 110 may be tightened via a lacing system to snugly secure the shoe 100 around the wearer's foot after it has been inserted through opening 108.

As shown in FIG. 1, the shoe 100 includes a reel-based lacing system 114 to tighten and secure the closure 110 and tongue 112 around the wearer's foot, in accordance with one embodiment of the invention. The reel-based lacing system 114 includes a reel assembly 116, a wire lace 118, and lace guides 120 and 121. The reel assembly 116 is attached to a top portion of the tongue 112 and contains a spool member (not shown) for holding the wire lace 118. The wire lace 118 is threaded through the plurality of lace guides 120, which also function as coupling mechanisms 120 to couple the reel-based lacing system to a wrap-around saddle assembly 122, as described in further detail below. When the reel assembly is turned in a predetermined direction (e.g., clockwise), the wire lace 118 is wound around the spool member and becomes shorter, thereby pulling the lace guides 120 and 121 on opposite sides of the closure 110 closer together to tighten the closure 110 around the wearer's foot. Reel-based lacing systems are known in the art and described, for example, in U.S. Patent Publications Nos. 2014/0123449 and 2013/0092780, and U.S. Pat. Nos. 8,516,662 and 8,468,657, which are incorporated by reference herein in their entireties. As disclosed in U.S. Patent Publication No. 2014/0123449, for example, in some embodiments, the reel assembly 116 includes a knob (e.g., knob 218 in U.S. Patent Publication No. 2014/0123449) that may be raised axially to disengage the knob from the spool member (e.g., spool member 216 in U.S. Patent Publication No. 2014/0123449) in order to allow the spool member to freewheel in a loosening direction to release the lace. In other embodiments, the knob may be manually and incrementally turned in the loosening direction to gradually loosen the lacing system.

The shoe 100 further includes the wrap-around saddle assembly 122 that forms a portion of the closure 110, and includes one or more wire loops 124 threaded through respective channels (not shown) of a saddle 126 that wraps around an underside of the upper 102, as discussed in further detail below. Each wire loop 124 is received within respective lace guide/coupling mechanisms 120 on opposite side edges of the saddle assembly 122 or closure 110. As shown in FIGS. 1-4, in one embodiment, three wire loops 124 extend from a respective coupling mechanism 120 affixed to one side edge of the saddle 126 and wraps around the side and bottom surfaces of the upper 102 to be coupled to a corresponding coupling mechanism 120 affixed to the opposite side edge of the saddle 126. The wire lace 118 is also threaded through lace guides 121 affixed to opposite side edges of the closure near a top portion of the closure 110 to further tighten and secure the closure 110 around the wearer's foot. When the reel assembly 116 is turned to tighten the wire lace 118 and the coupling mechanisms 120 and lace guides 121 on opposite sides of the saddle 126 and closure 110, respectively, are brought closer together, the wire loops 124 are pulled taut to tighten around a corresponding mid-portion of the wearer's foot that includes the arch of the foot. Thus, the wrap-around saddle assembly 122, in addition to forming a part of the closure 110, provides increased arch support, lateral stability, and a tighter fit around the middle portion of the wearer's foot, which decreases foot fatigue and thereby increases comfort and performance of the wearer's foot during a sporting activity.

Figure 2:
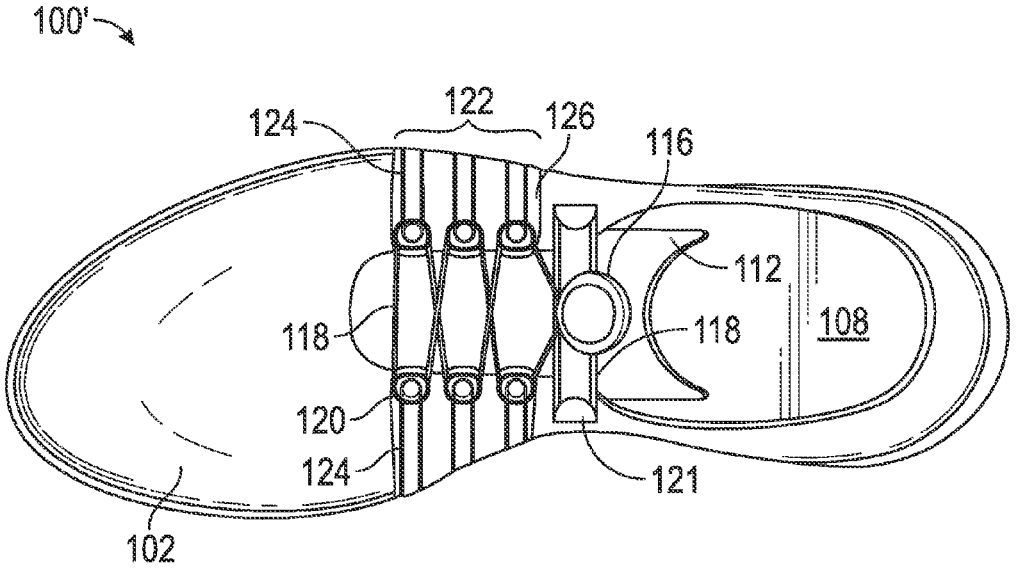
FIG. 2 is a top view of a right shoe corresponding to the left shoe of FIG. 1, in accordance with one embodiment of the invention.

FIG. 2 illustrates a top view of a right shoe 100' corresponding to the left shoe 100 of FIG. 1, in accordance with one embodiment of the invention. The right shoe 100' has the same features discussed above with respect to the left shoe 100 of FIG. 1. These common features are designated with the same reference numerals as in FIG. 1. As shown in FIG. 2, the wire lace 118 is laced in a traditional criss-cross pattern over the top of the tongue 112. It is understood, however, that any desired lacing pattern may be implemented in accordance with various embodiments of the invention. The wire lace 118 is secured to each side edge of the saddle 126 by a plurality (e.g., three) of coupling mechanisms 120 fixed to each side edge of the saddle 126 of the wrap-around saddle assembly 122. The wire lace 118 is further secured to lace guides 121 affixed to each side edge of the closure 110 near the top portion of the closure 110. When the reel assembly 116 is turned to tighten the wire lace 118, opposite side edges of the saddle 126 and the top portion of the closure 110 are brought closer together to tighten the upper 102 around the wearer's foot. Additionally, the wire loops 124 that wrap around the bottom of the mid-portion of the upper 102 tighten around the mid-portion and bottom arch of the foot to provide increased support and a more snug, custom fit around the wearer's foot.

Figure 3:
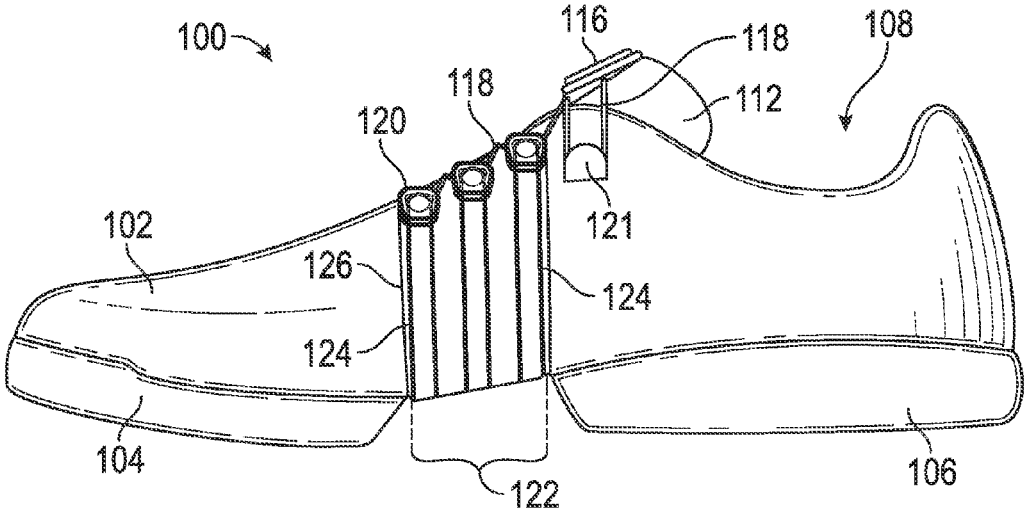
FIG. 3 is a side view of the shoe of FIG. 1, in accordance with one embodiment of the invention.
Figure 4:
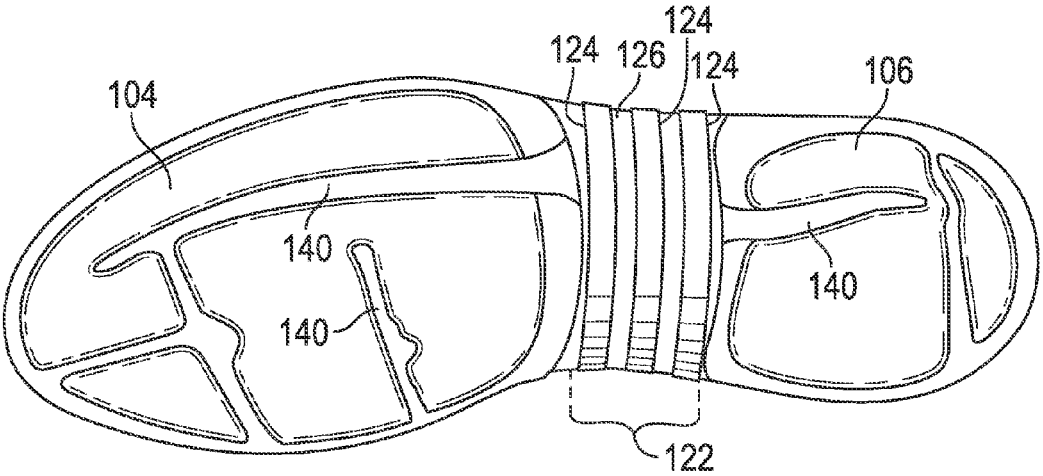
FIG. 4 is a bottom view of the shoe of FIG. 1, in accordance with one embodiment of the invention.

FIGS. 3 and 4 illustrates side and bottom views, respectively, of the shoe 100 of FIG. 1, in accordance with one embodiment of the invention. As shown in FIGS. 3 and 4, the wire loops 124 and saddle 126 of saddle assembly 122 wrap around a bottom portion of the upper 102 that is located between the front sole portion 104 and the heel sole portion 106, where no sole is present. Thus, as the wire loops 124 are tightened around the mid-portion of the shoe, as described above, increased arch support and a tighter, custom fit of the shoe is provided. Increased arch support and a custom fit increases the comfort and responsiveness of the shoe and decreases foot fatigue that may be experienced by a wearer during a sporting activity.

As further shown in FIG. 4, the front and heel soles 104 and 106 may include various grooves or indentations 140 in various patterns to provide enhanced flexibility, grip or traction to the bottom of the shoe 100. It is understood that any desired sole patterns may be implemented on the front and heel sole portions 104 and 106, respectively, in accordance with various embodiments of the invention. Additionally, cleats (not shown) may be fixed to the sole portions 104 and 106 in any desired configuration, number and size to provide increased gripping action on various surfaces such as natural or artificial turf, for example.

Figure 5:
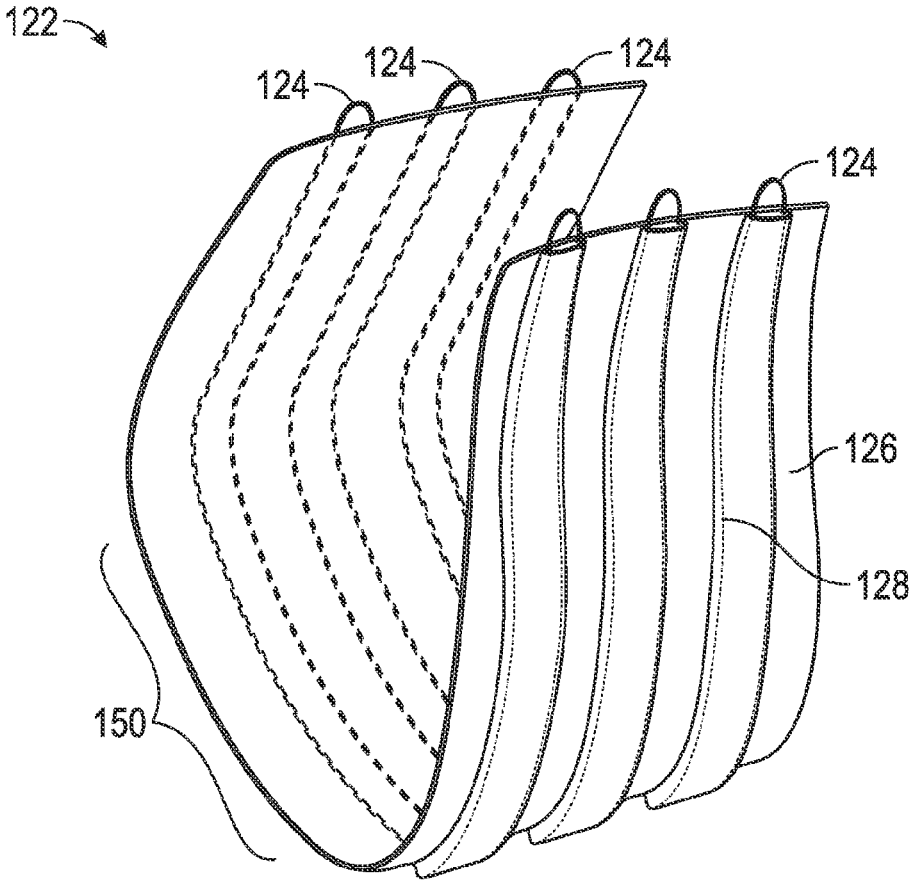
FIG. 5 is a perspective view of a wrap-around wire saddle, in accordance with one embodiment of the invention.

FIG. 5 illustrates a perspective view of a wrap-around saddle assembly 122 when detached from the shoe 100, in accordance with one embodiment of the invention. The saddle assembly 122 includes the saddle 126 and a plurality (e.g., three) wire loops 124 that are threaded through respective channels 128 (indicated by dashed lines) in the saddle 126 such that each wire loop 124 traverses the entire length of the saddle 126 to extend outwardly from each corresponding end of the saddle 126 where they can be coupled to corresponding, opposing coupling members 120, as discussed above. In an alternative embodiment, each wire loop 124 need not extend across the entire underside of the shoe but, instead, may be fixed (e.g., stitched, glued, etc.) to respective edge portions of the saddle 126 such that when the wire loop 124 is pulled taut, as described above, the saddle 126 is also pulled taut around the foot of the wearer. In one embodiment, at least a portion of the bottom portion 150 of the saddle 126 is fixed (e.g., stitched, glued, bonded, etc.) to a corresponding arch region of a bottom surface of the upper 102 (FIG. 3), or to the arch midsole reinforcement structure 221 (FIG. 8) so as to prevent undesired sliding or movement of the saddle 126 with respect to the upper 102 or arch midsole reinforcement structure 221.

The saddle 126 may be made from various known materials or combination of materials and implemented in various configurations (e.g., size, shape, thickness, etc.). The saddle 126 reinforces the middle portion of the upper 102 and provides enhanced support and stability to this area of the shoe 100. In various embodiments, the saddle 126 may be made from various materials known in the art, such as thermoplastic polyurethane or polyurea (TPU), rubber, leather, synthetic leather, textiles, and polyurethane or polyurea (PU), or carbon fiber, for example, or any combination of these materials to achieve desired strength, reinforcement and/or flexibility properties.

Figure 6:
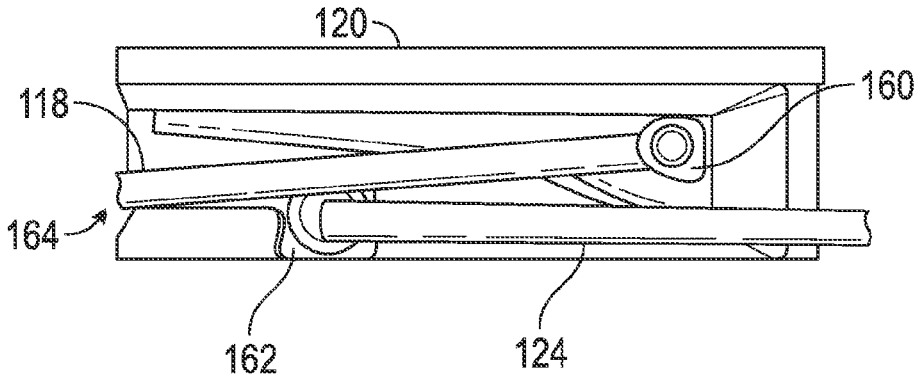
FIG. 6 is a cross-sectional side view of a coupling member having two wire loops contained therein, in accordance with one embodiment of the invention.

FIG. 6 illustrates a cross-sectional side view of a coupling member 120, in accordance with one embodiment of the invention. As shown in FIG. 6, the coupling member 120 includes a first channel 160 through which wire lace 118 of reel-based lacing system 114 (FIG. 1) may be threaded in accordance with known reel-based lacing techniques. The coupling member 120 further includes a second channel 162 into which a wire loop 124 may be inserted via slot 164. The slot 164 has a smaller height than a diameter of the second channel 162 such that once the wire loop 124 is inserted into the second channel 162, the smaller height of the slot 164 will prevent or resist movement of the wire loop 124 out of the second channel 162.

Figure 7:
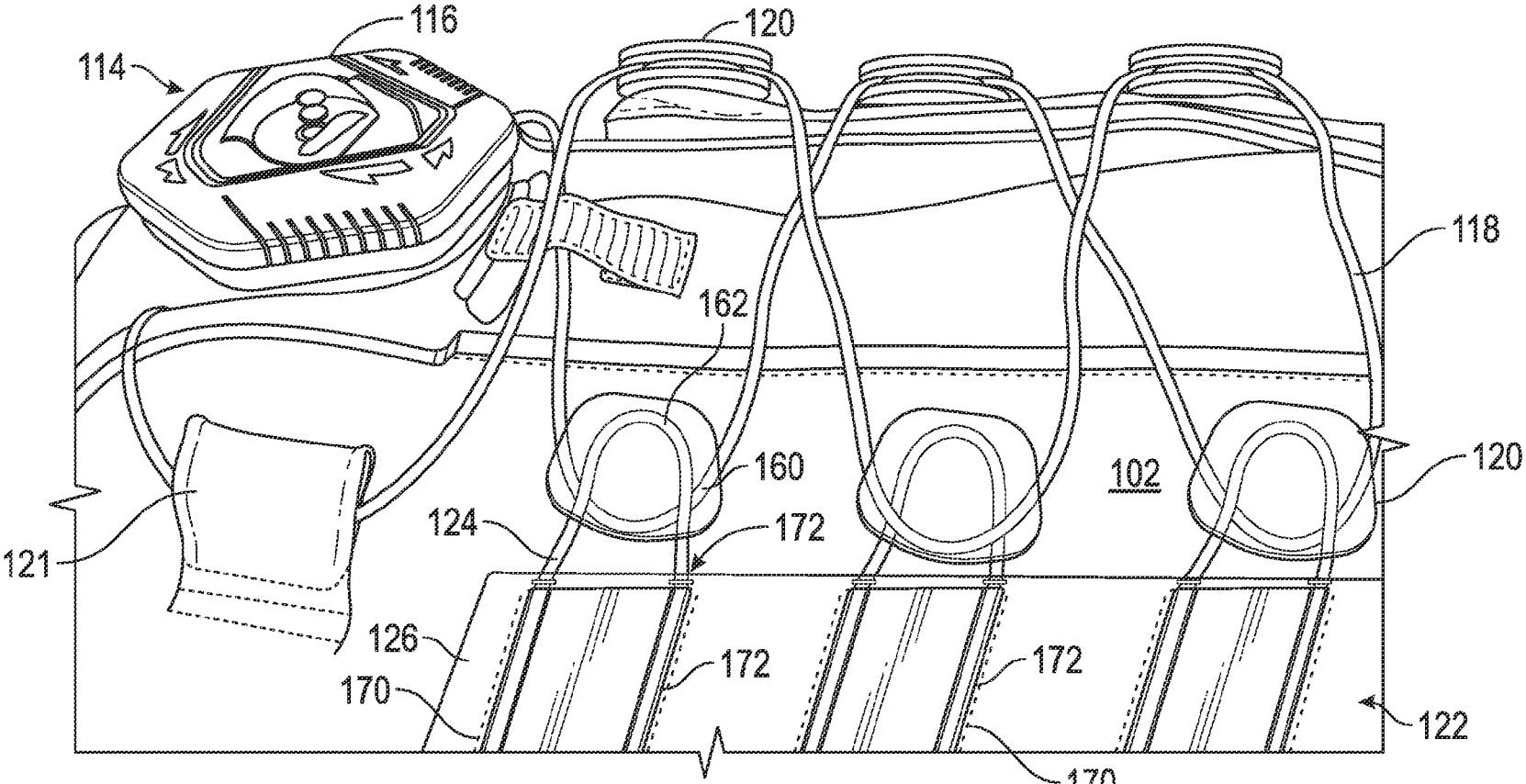
FIG. 7 illustrates a close-up view of a plurality of coupling members that couple a BOA reel-based lace system with the wrap-around wire saddle of FIG. 5, in accordance with one embodiment of the invention.

FIG. 7 illustrates a perspective close-up view of the reel-based lacing system 114 coupled to the wrap-around saddle assembly 122 via coupling members 120, as described above. As shown in FIG. 7, the reel-based lacing system 114 includes a reel assembly 116 for reeling in or out a wire lace 118, which is received within respective first channels 160 of a plurality of coupling members 120. Each wire loop 124 of the saddle assembly 122 is also received within respective second channels 162 of the coupling member 120. Thus, the coupling members 120 couple the reel-based lacing system 114 to the wrap-around saddle assembly. In FIG. 7, each coupling member 120 is shown as partially transparent to reveal the wires contained within each coupling member 120.

In one embodiment, the saddle 126 is affixed onto the upper 102 by sewing the saddle 126 onto the upper 102 as shown by stitching 170. It is understood however, that the saddle 126 may be fixed or loosely coupled to one or more portions of the upper 102 in any desired fashion (e.g., stitching, gluing, bonding, etc.). As also shown in FIG. 7, longitudinal grooves formed in the saddle 126 form respective channels 172 between the saddle 126 and the underlying upper 102 through which respective portions of wire loops 124 may travel and wrap around the side and bottom portions of the upper 102. In one embodiment, the stitching 170 forms an exterior boundary for containing respective wire loops 124 within their respective channels 172. As discussed above, as the reel assembly 116 is turned to reel in the wire lace 118, the wire loops 124 are tightened around the side and bottom portions of the upper 102 via the coupling members 120, thereby providing a tight fit around the arch and mid-foot area of the wearer.

FIG. 8 illustrates a side view of a golf shoe 200 in accordance with one embodiment of the invention. The golf shoe 200 has many similar features as the shoe 100 described above such as an upper 102, a reel assembly 116, wire laces 118, slightly modified coupling members 120' and lace guides 121', a wrap-around saddle assembly 122 having a plurality of wire loops 124 and a wrap-around saddle 126. For the sake of brevity, these common elements and features will not be described again here.

As shown in FIG. 8, the golf shoe 200 further includes a sole 202 having a front sole portion 204, a heel sole portion 206 and an arch sole portion 208 that couples the front and heel sole portions 204 and 206 together, as described in further detail below. The front sole portion 204 includes a front midsole 210 that is sandwiched between a bottom surface of a front portion of the upper 102 and a front outsole 212 attached to a bottom surface of the front midsole 210. A front midsole reinforcement structure 214 is attached to a top portion of the front midsole 210 and surrounds an upper portion of the front midsole 210 where the front midsole 210 contacts the bottom surface of the upper 102. Portions of the front midsole reinforcement structure 214 are fixed to portions of the front outsole 212 to provide a reinforcement frame that surrounds the front midsole 210. The front midsole reinforcement structure 214 may be fixed to the front outsole 212 using any known technique (e.g., bonding, gluing, fastening with screws, etc.) or, alternatively, may be integrally formed together using known injection molding techniques. In one embodiment, the front midsole reinforcement structure 214 and the front outsole can be made from a relatively dense ethyl vinyl acetate (EVA) or thermoplastic polyurethane (TPU) material that substantially prevents the respective portions of the front midsole 210 covered by the front midsole reinforcement structure 214 and the front outsole 212 from collapsing or substantially stretching in an outwardly direction, thereby providing increased strength and stability to the front midsole 210.

Similarly, the heel sole portion 206 includes a heel midsole 216 that is sandwiched between a bottom surface of a heel portion of the upper 102 and a heel outsole 218 attached to a bottom surface of the heel midsole 216. A heel midsole reinforcement structure 220 is attached to a top portion of the heel midsole 216 and surrounds an upper portion of the heel midsole 216 where the heel midsole 216 contacts the bottom surface of the heel portion of the upper 102. Portions of the heel midsole reinforcement structure 220 are fixed to portions of the heel outsole 218 to provide a reinforcement frame that surrounds the heel midsole 216. The heel midsole reinforcement structure 220 may be fixed to the heel outsole 218 using any known technique (e.g., bonding, gluing, fastening with screws, etc.) or, alternatively, may be integrally formed together using known injection molding techniques. In one embodiment, the heel midsole reinforcement structure 220 and the heel outsole 218 can be made from a relatively dense ethyl vinyl acetate (EVA) or thermoplastic polyurethane (TPU) material that substantially prevents the respective portions of the heel midsole 216 covered by the heel midsole reinforcement structure 220 and the heel outsole 218 from collapsing or substantially stretching in an outwardly direction, thereby providing increased strength and stability to the heel midsole 216.

As further shown in FIG. 8, the golf shoe 200 further includes an arch sole portion 208 comprising an arch outsole portion 219 that spans across and connects the front outsole portion 212 with the heel outsole portion 218, in accordance with one embodiment of the invention. The arch sole portion 208 further includes an arch midsole surrounded by an arch midsole reinforcement structure 221 and a window 222 between the arch midsole reinforcement structure and arch outsole portion 219, in accordance with one embodiment of the invention. In one embodiment, the saddle 126 wraps around the arch midsole and reinforcement structure 221 such that the window 222 (i.e., a space of air) is formed between the bottom surface of the saddle 126 and the arch outsole portion 219, as shown in FIG. 8. The window 222 allows for the saddle 126 to completely wrap around the side and bottom surfaces of the upper 102, and further allows for the expansion and contraction of the saddle 126 as the wire laces 118 and wire loops 124 are loosened or tightened, as described above. The window 222 further allows for increased flexion to the arch region of the shoe 200, and torsion between the front and heel portions of the shoe 200. In other words, the front and heel portions can more readily twist with respect to one another. To offset and/or control the amount of torsion between the front and heel portions of the shoe 200, the arch outsole portion 219 (a.k.a., torsion control bridge) is provided, as described in further detail below.

The arch outsole portion 219 provides further stability and torsion control to the middle section of the shoe 200 because it resists twisting of the front and heel portions of the upper 102 with respect to one another. A desired amount of torsion control can be achieved by adjusting the thickness, rigidity and/or physical material properties of the arch outsole portion 219. Further, the arch outsole portion 219 allows for the full-length of the outsole to touch the ground and thus provides for traction along the full length of the shoe 200. It further provides an increased outsole surface area that contacts the ground, thereby providing increased traction while still allowing for a desired level of torsion/twisting of the shoe. Thus, the arch outsole portion 219 provides a torsion control bridge between the front and heel outsole portions 212 and 218, that allows the front and heel portions of the shoe 200 to move independently of one another to a desired degree, but not substantially beyond the desired amount. The arch outsole portion 219 further increases the length and surface area of the outsole that contacts the ground to provide increased traction during a sporting activity.

In FIG. 8, both the arch midsole and its surround arch midsole reinforcement structure are collectively illustrated as the structure 221 since the arch midsole is contained within or surrounding by the arch midsole reinforcement structure. In one embodiment, the arch midsole and surrounding arch midsole reinforcement structure 221 extends across a middle portion of the bottom surface of the upper 102 to provide further support and stability in the arch region of the shoe 200, in accordance with one embodiment of the invention. The arch midsole reinforcement structure 221 provides a relatively rigid frame or housing that surrounds and contains an arch midsole made from a relatively less rigid material (e.g., eTPU) located under the arch region of the upper 102. The wrap-around saddle 126 wraps around the arch midsole and arch midsole reinforcement structure 221 and, in one embodiment, is secured or affixed thereto. In one embodiment, the front, heel and arch midsole reinforcement structures 214, 220 and 221, respectively, are integrally formed with one another and extend across substantially all of the bottom surface of upper 102, as shown in FIG. 8.

In one embodiment, the front and heel midsoles 210 and 216, as well as the arch midsole, discussed above can be made from an expanded TPU (eTPU) material (aka, Boost™ foam). Such eTPU and other foams based on thermoplastic polyurethanes (TPU) suitable for use to form the midsole and/or outsole layers, in accordance with various embodiments, are described in further detail in U.S. Pat. App. Pub. No. 2010/0222442 A1, which is incorporated by reference herein in its entirety. Additionally, exemplary methods for production of eTPU using water as a blowing agent or propellant are described in U.S. Pat. App. Pub. No. 2012/0065285 A1, which is incorporated by reference herein in its entirety. In some embodiments, the midsole layer can comprise a hybrid material comprising a matrix of PU and foamed particles of TPU or other thermoplastic elastomers, as described in U.S. Pat. App. Pub. No. 2010/0047550 A1, which is incorporated by reference herein in its entirety.

Some exemplary advantages of using Boost™ foam as a midsole material is that it is light weight and possesses superior energy-return or rebound properties that promote smooth energy transfer during the swing. The Boost™ foam also results in a lighter weight shoe, which further reduces fatigue to the wearer, especially if he or she is walking a golf course. The Boost™ foam also provides consistent and responsive cushioning across dynamic temperature ranges from subzero cold to punishing heat, thereby retaining its advantageous properties in any weather.

In an alternative embodiment, the wrap-around saddle assembly 122 may be omitted and a shoe may utilize a traditional lacing system or reel-based lacing system. In this embodiment, the arch outsole portion 219 can still function to provide enhanced traction, stability and torsion control to the shoe, as described above.

In one embodiment the arch outsole portion 219 is integrally formed with the front and heel outsole portions 212 and 218, and made from the same outsole materials described above. In alternative embodiments, the arch outsole portion 219 may be made from the same or a different material and mechanically attached to the front and heel outsole portions 212 and 216 such that it may be detached and interchanged with various different arch outsole portions (not shown) having different physical characteristics to achieve different desired performance characteristics of the shoe 200.

Figure 9:
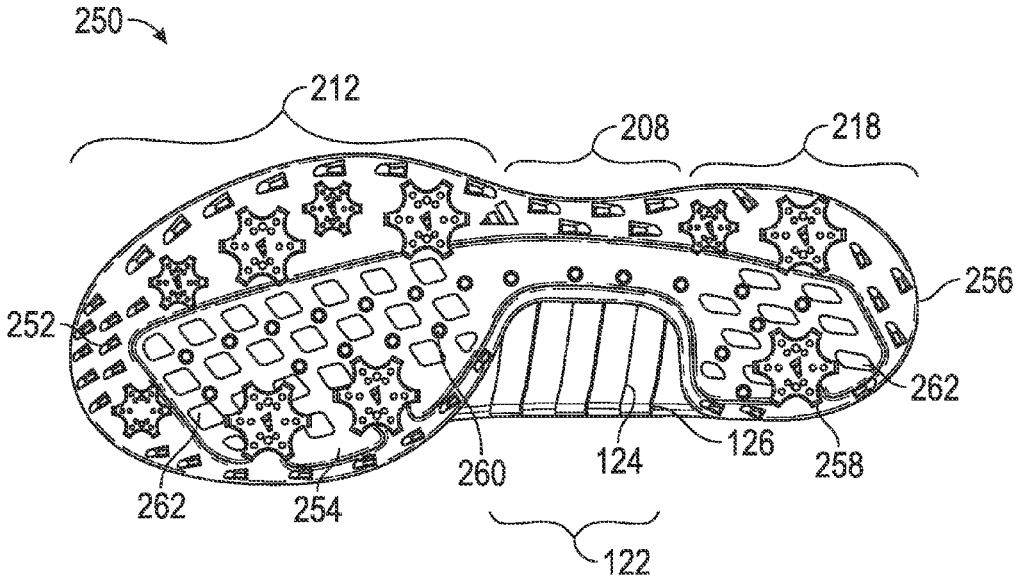
FIG. 9 is a bottom view of the golf shoe of FIG. 8, in accordance with one embodiment of the invention.

FIG. 9 illustrates a bottom surface of an outsole 250 that can be utilized in connection with the golf shoe 200 of FIG. 8, in accordance with one embodiment of the invention. As shown in FIG. 9, the outsole 250 has a peripheral region 252 (shown as a darker region) that surrounds an interior region 254 (shown as a lighter region). In one embodiment, the dimensions (e.g., thickness) and/or material(s) used to form the peripheral region 252 provide greater rigidity and durability when compared to the interior region 254. The greater rigidity and durability of the peripheral region 252 provides increased support and strength to the peripheral frame of the shoe 200 and allows for relatively larger traction elements 256 and 258 to be formed on or affixed to the peripheral region 252 of the outsole 250 to provide increased traction.

A plurality of relatively smaller traction elements 260 extend outwardly from a bottom surface of the interior region 254 to provide further traction to supplement the traction provided by the larger traction elements 256 and 258 on the peripheral region 252. The interior region 254 further includes a plurality of holes 262 that allows the midsole material (e.g., Boost™) to expand through the holes 262, which allows for greater deformation of the midsole material and, hence, an enhanced "shock absorbing" property of the midsoles 210 and 216. The holes 262 also significantly decrease the weight of the interior region 254 of outsole 250, which reduces fatigue to a wearer, especially if they are walking long distances.

As also shown in FIG. 9, the wrap around saddle assembly 122, comprising the saddle 126 and wire loops 124, is located directly above the arch outsole portion 219 with no midsole material sandwiched therebetween. As discussed above, a window of open space 222 (FIG. 8) between the arch outsole portion 219 and the wrap-around saddle assembly 122 allows the saddle 126 and wire loops 124 to be completely wrapped around the side and bottom surfaces of the upper 102, and to be tightened or loosened using the reel-based lacing system 114 (FIG. 1), as described above.

In various embodiments the traction elements 256, 258 and 260 may be formed in various ways and made from various materials known in the art. In one embodiment, for example, the traction elements 256, 258 and 260 may be formed using GripMore™ technology, in which a plurality of cleat and/or traction elements may be attached to a bottom surface of a flexible fiber cloth or mesh textile lining that is cut and shaped to match the size and shape of each corresponding traction zone on a bottom surface of the outsole(s) 208, 212 and/or 218. The Gripmore™ technology is described in further detail in Taiwan Publication No. TW M412636U1, the entirety of which is incorporated by reference herein.

In one embodiment, the fiber cloth or mesh lining is fixedly adhered to a correspondingly sized and shaped indented bottom surface of the outsole corresponding to each respective traction zone. Multiple durometer plastic cleats are then injected into the fiber cloth so as to be permanently held in place by means of known techniques. For example, the cleats which can be made of a highly durable TPR (thermoplastic rubber) are injected onto a lightweight but strong mesh textile lining and affixed with commercial grade adhesives for a secure bond. The mesh backing with injected cleats is then set into a pre-defined area in the outsole (commonly made from TPU) and glued in place to form the traction elements needed as per the sporting activity requirements.

In various embodiments, the flexible fiber cloth or mesh lining can be made from known plastics, rubber or other flexible, durable materials, or any combination of such materials. In various embodiments, the cleats or traction elements can be made from suitable polyurethane (PU) materials. The flexible fiber cloth can be cut and shaped to be attached to premade indentations in the bottom surface of the outsole. The flexible fiber cloth can be permanently attached to the bottom surface of the outsole by any suitable means, such as gluing, bonding, etc.

The Gripmore™ cleat technology provides many advantages for shoes requiring cleats. The fiber cloth can be ideally shaped, preformed and placed as desired without restriction to provide any cleat or traction element configuration. Additionally, since conventional cleat receptacle structures for receiving and securing a cleat therein are no longer required, the manufacturing cost and weight of the golf shoes are significantly decreased. Further, since cleat receptacle structures are no longer required, the size and placement of cleats on the bottom surface of the outsole are no longer limited by available space for the receptacle structures in the midsole layer.

The various elements of the shoes described herein can be made from known suitable materials to achieve desired performance, durability and comfort characteristics, in accordance with various embodiments of the invention. For example, in one embodiment, the upper 102 may be made from a breathable microfiber leather, or similar material, with varying thicknesses in various portions of the upper to achieve desired characteristics and properties. As another example, the outsoles discussed above may be made from an EVA or TPU material, and can be injection molded with one or more types of thermoplastic polyurethane (TPU). The midsoles discussed above can be formed by pouring PU or Boost™ foam material into respective TPU molds of the front and heel outsole portions. Thus, the soles described herein, comprising midsole and outsole layers, can provide increased comfort and performance compared to conventional golf shoe soles having a single rigid platform that spans the sole and supports the traction elements in a dependent manner.

The poured midsole can provide a durable yet soft and comfortable region below the golfer's foot and can bond directly to the injection molded outsole without cement or other rigid adhesion materials. The lower outsole can comprise a durable yet flexible material and can include various traction elements supported independently from one another such that they can flex and move separately throughout the golf swing, which results in more of the traction elements being in contact with the ground at any given time and allows the golfer's foot to have more freedom of motion and more comfort. Additionally, the soles described herein can be lighter than conventional soles due to the use of light-weight polymeric materials, direct bonding of the constituent materials without cement, lack of other conventional platform components, and other properties.

In one embodiment, the midsole can be bonded directly to the outsole without an intermediate adhesive material. The midsole can comprise various foams and hybrid materials, such as a matrix of PU and foamed particles of TPU or eTPU. Various soles and methods of making soles may be utilized in accordance with the present invention, such as those described in U.S. patent application Ser. No. 14/513,582, filed on Oct. 14, 2014, claiming priority to U.S. Provisional Application Ser. No. 61/896,442, filed on Oct. 28, 2013, both of which are incorporated by reference herein in their entireties. It should be noted that in these previous applications, what is referred to as the "midsole" herein is referred to as the "upper outsole." In further embodiments, the sole of a golf shoe may be made from various material layers as described in U.S. Publication No. 2013/0291409 A1, the entirety of which is incorporated by reference herein.

Although various embodiments described above focus on the use of Boost™ foam material for the midsole, other embodiments of the invention are not limited to using a particular type of material for the midsole, which can be made from any other suitable material such as TPU, Rubber, EVA, etc., or combination of such materials.

Additionally, other components or elements of the shoes described herein can be made from any suitable material or combination of materials using any technique known to those skilled in the art. For example, the wire laces 118 and wire loops 124 may be made from any suitable material or combination of materials (e.g., steel, plastics, etc.) that have the desired strength and durability properties for a given activity. In one embodiment, the wire laces 118 and 124 are made from nylon-coated stainless steel.

Various exemplary embodiments of the invention have been described above to provide shoes having enhanced mid-foot and arch support and customizable fit and/or increased torsional control and traction under a mid-foot region of the shoe. It should be understood that the various embodiments described herein have been presented by way of example only, and not by way of limitation. Likewise, the various figures or diagrams presented depict an example design, structure or configuration, which is done to aid in understanding the concepts, features and functionality that can be included in various shoe pairs in accordance with one or more embodiments of the invention. The invention is not restricted to the illustrated exemplary designs, structures or configurations, but can be implemented using a variety of alternative designs, structures and configurations depending on the particular sporting activity (e.g., golf, baseball, track and field, etc.) or performance characteristics desired for a particular application.

Additionally, it should be understood that the various features and functionality described in one or more of the individual embodiments are not limited in their applicability to the particular embodiment with which they are described, but instead can be applied, alone or in some combination, to one or more of the other embodiments of the invention, whether or not such embodiments are explicitly described and whether or not such features are presented as being a part of a particular described embodiment. Thus, the breadth and scope of the present invention should not be limited by any of the above-described exemplary embodiments but should be given a scope commensurate with the claims.

What is claimed is:

1. A shoe, comprising:

an upper configured to receive therein a foot of a wearer of the shoe, the upper comprising a closure and a tongue configured to cover a top portion of the foot;

a front sole portion attached to a front portion of a bottom surface of the upper, the front sole portion comprising a front midsole made from a first material, a front outsole made from a second material that is more rigid than the first material, and a front midsole reinforcement structure made from a third material that is more rigid than the first material, the front midsole being at least partially contained by the front midsole reinforcement structure and the front outsole;

a heel sole portion attached to a heel portion of the bottom surface of the upper, the heel sole portion comprising a heel midsole made from the first material, a heel outsole made from the second material, and a heel midsole reinforcement structure made from the third material, the heel midsole being at least partially contained by the heel midsole reinforcement structure and the heel outsole; and a torsion control bridge connecting the front and heel sole portions, wherein a window is formed between the torsion control bridge and a portion of the bottom surface of the upper located between the front and heel sole portions.

2. The shoe of 1, wherein the second and third materials have different compositions from one another.

3. The shoe of claim 2, wherein the first material comprises an expanded thermoplastic polyurethane (eTPU).

4. The shoe of claim 1, wherein the torsion control bridge comprises an arch outsole portion disposed between the front and heel outsole portions and integrally formed with the front and heel outsole portions.

5. The shoe of claim 4, wherein the front and heel outsoles each comprise a medial portion and a lateral portion, wherein the medial portions of the front and heel outsoles are integrally formed with one another and the lateral portions of the front and heel outsoles are integrally formed with one another.

6. The shoe of claim 5, wherein the medial portions of the front and heel outsoles comprise a plurality a holes therein for allowing respective portions of the front and heel midsoles to expand there through.

7. The shoe of claim 4, further comprising a plurality of traction elements located on bottom surfaces of the front and heel outsoles.

8. The shoe of claim 1, further comprising:

an arch midsole made from the first material and disposed between the front and heel midsoles; and an arch midsole reinforcement structure made from the third material and disposed between the front and heel midsole reinforcement structures, wherein the arch midsole reinforcement structure reinforces at least a portion of the arch midsole.

9. The shoe of claim 8, further comprising:

a reel assembly coupled to the tongue;

at least one wire lace coupled to the reel assembly and opposing edges of the closure such that when the reel assembly is turned in a first direction, the at least one wire lace pulls the opposing edges of the closure closer together and, when the reel assembly is turned in a second direction, the at least one wire lace releases and allows the opposing edges to move away from each other; and a wrap-around saddle assembly comprising a saddle and at least one saddle wire coupled to the saddle, wherein the saddle wraps around an arch portion of the upper located between the front and heel sole portions and the at least one saddle wire is coupled to the at least one wire lace such that when the reel assembly is turned in the first direction, the at least one saddle wire tightens the saddle around the arch portion of the upper and when the reel assembly is turned in the second direction, the at least one saddle wire loosens the saddle around the arch portion of the upper, and wherein the window is formed between a top surface of the torsion control bridge and a bottom surface of the saddle.

10. A golf shoe, comprising:

an upper configured to receive therein a foot of a wearer of the shoe, the upper comprising a closure and a tongue configured to cover a top portion of the foot;

a front sole portion attached to a front portion of a bottom surface of the upper, the front sole portion comprising a front midsole comprising a first material and a front outsole comprising a second material that is more rigid than the first material, a front midsole reinforcement structure comprising a third material that is more rigid than the first material, the front midsole being at least partially contained by the front midsole reinforcement structure and the front outsole;

a heel sole portion attached to a heel portion of the bottom surface of the upper, the heel sole portion comprising a heel midsole comprising the first material and a heel outsole comprising the second material;

a heel midsole reinforcement structure comprising the third material, the heel midsole being at least partially contained by the heel midsole reinforcement structure and the heel outsole;

an arch outsole comprising the second material and connecting the front and heel outsoles, wherein a window is formed between the arch outsole and a portion of the bottom surface of the upper located between the front and heel sole portions; and a plurality of traction elements disposed on bottom surfaces of the front and heel outsoles.

11. The golf shoe of claim 10, further comprising an arch midsole made from the first material and disposed between the front and heel midsoles.

12. The golf shoe of claim 11, further comprising:

an arch midsole reinforcement structure comprising the third material and disposed between the front and heel midsole reinforcement structures, wherein the arch midsole reinforcement structure reinforces at least a portion of the arch midsole.

13. The golf shoe of claim 10, wherein the second and third materials have different compositions from one another.

14. The golf shoe of claim 10, wherein the first material comprises an expanded thermoplastic polyurethane (eTPU).

15. The golf shoe of claim 10, wherein the arch outsole is integrally formed with the front and heel outsoles.

16. The golf shoe of claim 15, wherein the front and heel outsoles each comprise a medial portion and a lateral portion, wherein the medial portions of the front and heel outsoles are integrally formed with one another and the lateral portions of the front and heel outsoles are integrally formed with one another.

17. The golf shoe of claim 16, wherein the medial portions of the front and heel outsoles comprise a plurality of holes therein for allowing respective portions of the front and heel midsoles to expand there through.

18. The golf shoe of claim 10, further comprising:

a reel assembly coupled to the tongue;

at least one wire lace coupled to the reel assembly and opposing edges of the closure such that when the reel assembly is turned in a first direction, the at least one wire lace pulls the opposing edges of the closure closer together and, when the reel assembly is turned in a second direction, the at least one wire lace releases and allows the opposing edges to move away from each other; and a wrap-around saddle assembly comprising a saddle and at least one saddle wire coupled to the saddle, wherein the saddle wraps around an arch portion of the upper located between the front and heel sole portions and the at least one saddle wire is coupled to the at least one wire lace such that when the reel assembly is turned in the first direction, the at least one saddle wire tightens the saddle around the arch portion of the upper and when the reel assembly is turned in the second direction, the at least one saddle wire loosens the saddle around the arch portion of the upper, and wherein the window is formed between a top surface of the torsion control bridge and a bottom surface of the saddle.

19. The golf shoe of claim 18, further comprising:

a first set of coupling mechanisms coupled to a first opposing edge of the closure; and a second set of coupling mechanisms coupled to a second opposing edge of the closure, wherein the first and second set of coupling mechanisms couple the at least one wire lace to the at least one saddle wire.

20. The golf shoe of claim 19, wherein:

the first set of coupling mechanisms comprises first, second and third coupling mechanisms coupled to the at least one wire lace and disposed adjacent to each other on the first opposing edge of the closure;

the second set of coupling mechanisms comprises fourth, fifth and sixth coupling mechanisms coupled to the at least one wire lace and disposed adjacent to each other on the second opposing edge of the closure; and the at least one saddle wire comprises first, second and third wire loops, the first wire loop having a first end coupled to the first coupling mechanism and a second end coupled to the fourth coupling mechanism, the second wire loop having a first end coupled to the second coupling mechanism and a second end coupled to the fifth coupling mechanism, and the third wire loop having a first end coupled to the third coupling mechanism and a second end coupled to the sixth coupling mechanism.

21. A method of manufacturing a shoe, comprising:

providing an upper configured to receive therein a foot of a wearer of the shoe, the upper comprising a closure and a tongue configured to cover a top portion of the foot;

attaching a front sole portion to a front portion of a bottom surface of the upper, the front sole portion comprising a front midsole made from a first material, a front outsole made from a second material that is more rigid than the first material, and a front midsole reinforcement structure made from a third material that is more rigid than the first material, the front midsole being at least partially contained by the front midsole reinforcement structure and the front outsole;

attaching a heel sole portion to a heel portion of the bottom surface of the upper, the heel sole portion comprising a heel midsole made from the first material, a heel outsole made from the second material, and a heel midsole reinforcement structure made from the third material, the heel midsole being at least partially contained by the heel midsole reinforcement structure and the heel outsole; and providing a torsion control bridge between the front and heel sole portions, wherein a window is formed between the torsion control bridge and a portion of the bottom surface of the upper located between the front and heel sole portions.

22. The method of manufacturing of claim 21, wherein the second and third materials have different compositions from one another.

23. The method of manufacturing of claim 21, wherein the first material comprises an expanded thermoplastic polyurethane (eTPU).

24. The method of manufacturing of claim 21, wherein the torsion control bridge comprises an arch outsole portion disposed between the front and heel outsole portions and integrally formed with the front and heel outsole portions.

25. The method of manufacturing of claim 21, wherein the front and heel outsoles each comprise a medial portion and a lateral portion, wherein the medial portions of the front and heel outsoles are integrally formed with one another and the lateral portions of the front and heel outsoles are integrally formed with one another.

26. The method of manufacturing of claim 21, wherein the medial portions of the front and heel outsoles comprise a plurality a holes therein for allowing respective portions of the front and heel midsoles to expand there through.

27. The method of manufacturing of claim 21, further comprising providing a plurality of traction elements on bottom surfaces of the front, mid and heel outsoles.

28. The method of manufacturing of claim 21, further comprising:

providing an arch midsole made from the first material between the front and heel midsoles; and providing an arch midsole reinforcement structure made from the third material between the front and heel midsole reinforcement structures, wherein the arch midsole reinforcement structure reinforces at least a portion of the arch midsole.

* * * * *